US005910055A

United States Patent [19]

Bennett

[11] Patent Number: 5,910,055

[45] Date of Patent: Jun. 8, 1999

[54] GOLF CLUB

[76] Inventor: John E. Bennett, 1570 Homewood Dr., Altadena, Calif. 91001

[21] Appl. No.: 08/980,694

[22] Filed: Nov. 24, 1997

[51] Int. Cl.[6] ..... A63B 53/02

[52] U.S. Cl. ..... 473/305; 473/313; 473/329; 473/242; 473/349

[58] Field of Search ..... 473/226, 231, 473/227, 238, 242, 223, 225, 243, 251, 244, 313, 340, 341, 329, 342, 305, 349

[56] References Cited

U.S. PATENT DOCUMENTS

| | | | |
|---|---|---|---|
| Re. 19,178 | 5/1934 | Spiker | 473/340 |
| D. 223,767 | 6/1972 | Houghtaling . | |
| 3,851,877 | 12/1974 | Giambazi | 473/341 |
| 3,917,277 | 11/1975 | Beck | 473/244 |
| 3,992,015 | 11/1976 | Benson | 473/313 |
| 4,147,357 | 4/1979 | Strop | 473/313 |
| 4,291,883 | 9/1981 | Smart | 473/244 |
| 4,647,045 | 3/1987 | Bilyeu | 473/238 |
| 4,951,949 | 8/1990 | Kastenhuber | 473/313 |
| 5,083,778 | 1/1992 | Douglass | 473/329 |
| 5,505,447 | 4/1996 | Mockovak | 473/308 |
| 5,542,675 | 8/1996 | Micciche | 473/329 |
| 5,577,968 | 11/1996 | Pritchett | 473/305 |

FOREIGN PATENT DOCUMENTS

| | | | |
|---|---|---|---|
| 2230461 | 10/1990 | United Kingdom | 273/167 R |
| WO84/03447 | 9/1984 | WIPO | 273/81 B |

*Primary Examiner*—Sebastiano Passaniti
*Attorney, Agent, or Firm*—Donald E. Stout

[57] ABSTRACT

A novel and unique golf club, particularly a putter, is disclosed which has an effective structure for attaching the shaft of the club to the club head, such that the result is a self-compensating putter and consistently accurate putts. In a preferred embodiment, a golf club is provided which comprises a shaft and a club head having a front face. The club head has a length along which the front face extends. Advantageously, the shaft is attached to the club head at two discrete mounting locations along the length of the club head, which results in a consistently stable and comfortable swing.

18 Claims, 4 Drawing Sheets

GOLF CLUB

BACKGROUND OF THE INVENTION

This invention relates to an improved constructional design for golf clubs, and more particularly to an advantageous configuration for attaching a golf club shaft to a putter head.

The game of golf has consumed the weekends and passions of millions of people worldwide for many years, and increasingly so in recent years as its popularity has soared. The reasons for its popularity are legion, and include the beautiful settings in which it is played, the opportunity for leisurely exercise, companionship, and the elusive satisfaction of successfully navigating a small white ball several hundred yards from a golf tee into a small hole, using just a few strokes of a golf club.

While many people spend a great deal of time perfecting their tee shots, hoping to add distance to their drives, it is the putting stroke which usually determines the ultimate success of a golfer. Putting is an uncertain, uncontrolled, and intimidating demand in the game of golf. The reward from putting is often inconsistent with the overall skill and efforts of the player.

The difficulties with current state-of-the-art putters arise because of weight distribution at the putter head, and the fact that the club shaft is typically off-center with respect to the head. This causes a moment about the axis of the shaft when the club is put into motion. To compensate for this, in conventional putters the ends of the club head are often weighted more and various points of attachment between the shaft and the putter head have been tried. The torsional force on the club head as the putter is swung is felt unconsciously by the player, who then involuntarily adjusts his swing and grip to maintain control and to keep the club head square.

Thus, when the putter is moved backward at the start of the swing, the toe end of the putter head tends to remain behind, and conversely, on the beginning of the down swing, it again remains behind. Similarly, at impact with the ball, the putter head again has a tendency to turn or wobble because the weight mass is not at the impact point. This is the basic problem with putter designs, and has never been totally successfully addressed.

Therefore, what is needed is a new design for a golf putter which addresses the problem of weight distribution and generated torsion during the swing of the putter, compensating for the torsional effect by an offsetting moment so that the net effect is a very stable swing and a resultant accurate putt.

SUMMARY OF THE INVENTION

The present invention solves the aforementioned problems with prior art putters by providing a novel and unique putter having, in particular, an effective structure for attaching the shaft of the putter to the putter head, such that the result is a self-compensating putter which contributes to consistently accurate putts.

More particularly, a golf club, preferably a putter, is provided which comprises a shaft and a club head having a front face. The club head has a length along which the front face extends. Advantageously, the shaft is attached to the club head at two discrete mounting locations along the length of the club head, which results in a consistently stable and comfortable swing, such that the club head becomes naturally square and remains square at impact.

To effect the aforementioned shaft attachment, a "hosel frame" is provided, which is disposed between the shaft and the club head. The hosel frame comprises a hosel and two prongs, wherein each of the prongs are attached to the club head at a corresponding one of the two discrete mounting locations.

Another feature of the invention is the provision of slots on the club head, particularly in the upper half thereof. These slots may be of any desired number and depth, so that the weight of the club head may be modified without redesigning the configuration thereof, by varying the number and depth of the slots. The slots also provide a pleasing aesthetic appearance.

Still another feature of the inventive putter, is the ability to employ a layer of softening material on the front face of the club head, to provide a desired "touch" for certain types of putts. The club head face may be textured to receive the layer of softening material and to enhance the cushioning property of the added layer.

The top of the club head is preferably constructed to comprise a straight ridge along its entire length, in order to function as a straight edge to assist a golfer in aligning the club with a golf ball.

In another aspect of the invention, a golf club is provided which comprises a shaft and a club head having a front face, wherein the club head has a length along which the front face extends. Advantageously, the shaft is attached to the club head through an attachment zone which extends along at least 30 percent of the length of the club head. This attachment zone may comprise a continuous joint between the club head and the shaft or hosel frame, or may alternatively comprise a region between two spaced discrete mounting locations along the length of the club head, each of the mounting locations being disposed at opposed ends of the attachment zone. Whether a single continuous joint or a plurality of discrete mounting locations are employed, the important result is that a significant portion of the club head is subject to control by the shaft of the club, to prevent wobble during the swing and to counteract the torsion which is typically generated when a state of the art club having a single point of attachment between the shaft and the club head is swung. In fact, it is preferred that this attachment zone comprise at least 50 percent of the length of the club head.

In still another aspect of the invention, a golf putter is provided which comprises a shaft and a club head having a front face. The club head has a length along which the front face extends. An alignment indicating means, preferably comprising a coil spring, but also possibly comprising a rigid bar or some other equivalent structure, is disposed on a top center portion of the club head and extending rearwardly therefrom. The alignment indicating means extends along an axis transverse to the front face, and is preferably removably attached to the club head.

The invention, together with additional features and advantages thereof, may best be understood by reference to the following description taken in conjunction with the accompanying illustrative drawings.

DESCRIPTION OF THE PREFERRED EMBODIMENT

Figure 1:
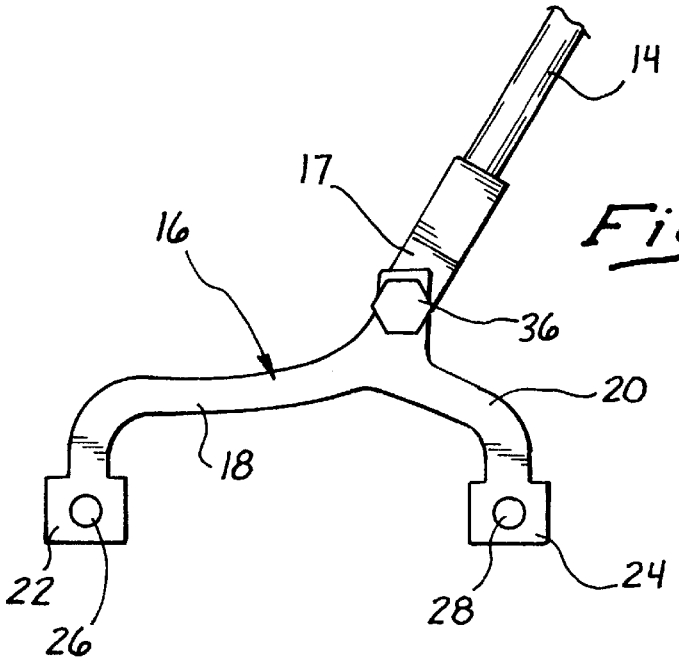
FIG. 1 is a front plan view of the shaft and hosel frame of a golf club constructed in accordance with the principles of the present invention.
Figure 2:
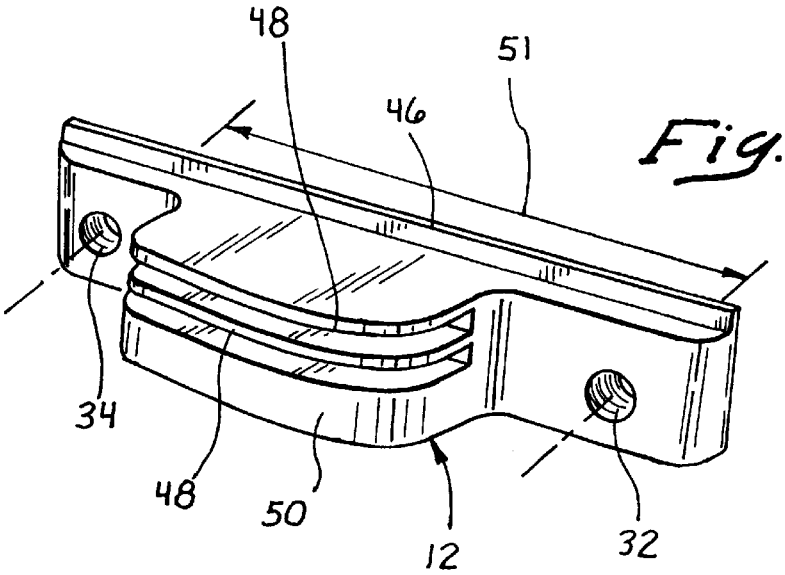
FIG. 2 is a perspective view of a golf putter head constructed in accordance with the principles of the present invention.
Figure 3:
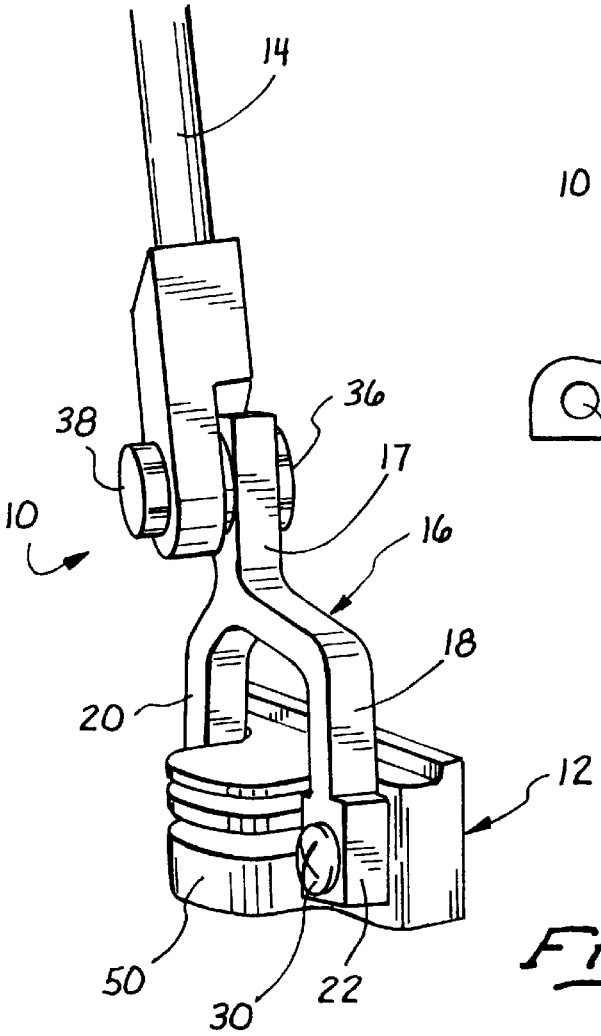
FIG. 3 is a perspective view of a golf putter constructed in accordance with the principles of the present invention.

Referring now more particularly to the drawings, FIGS. 1–3 illustrate a first embodiment of a golf putter 10 which is constructed in accordance with the principles of the invention. The golf putter 10 comprises a club head 12 (FIGS. 2 and 3), a shaft 14 (FIGS. 1 and 3), and a hosel frame 16 (FIGS. 1 and 3). Preferably, the hosel frame comprises a hosel 17, a first prong 18 and a second prong 20, each of which has disposed at its distal end an attachment flange 22, 24, respectively (see FIG. 1). Each attachment flange 22, 24 includes an aperture 26, 28, respectively, through which a mechanical fastener 30 may be disposed in order to attach the hosel frame 16 to the club head 12, as shown in FIG. 3. The mechanical fastener 30 may comprise a screw, as illustrated in the drawings, which is engaged with threaded openings 32, 34 in the club head 12 (FIG. 2), or it may alternatively comprise any other known type of fastening means, such as bolts, rivets, pins, cast studs, welds, or the like. Similarly, the shaft 14 may be attached to the hosel frame 16 by means of a bolt 36 and nut 38 (FIG. 3). Still another preferred alternative is to cast the hosel frame and club head, and/or the shaft and hosel frame, as one unit. The hosel frame may be attached to either the top or the rear of the club head. When the attachment is at the rear of the club head, the hosel frame supports and pushes the club head squarely from the rear during the swing and at impact, giving a more positive impact on the ball, more precise direction to the ball, and better control of the club. On the other hand, when the attachment is on the top of the club head, a pendulum effect is created in the swing and feel of the club. This pendulum effect enables a truer impact on the ball, maintains the club head square throughout the swing and through the impact on the ball, and makes the swing easier to manage.

Figure 4:
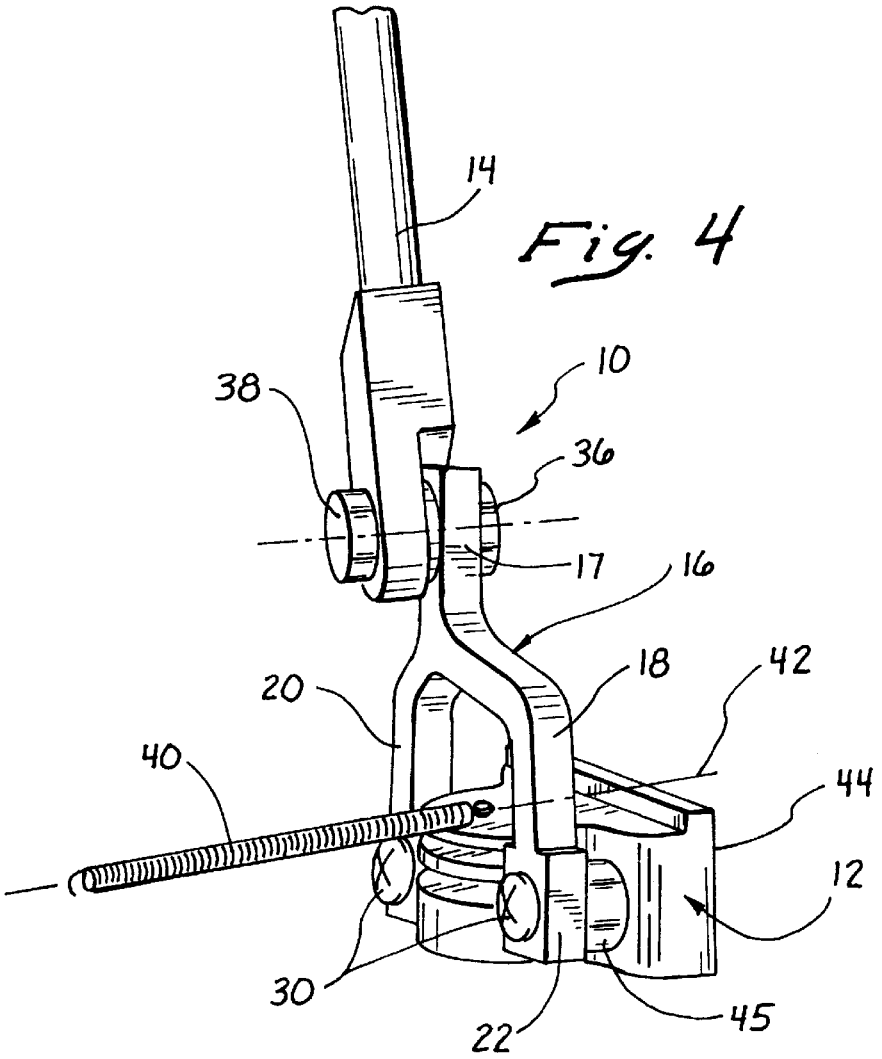
FIG. 4 is a perspective view similar to that of FIG. 3, illustrating a somewhat modified embodiment of the inventive golf putter.

Referring now more particularly to FIG. 4, the golf putter 10 illustrated in FIG. 3 is again shown, but in the FIG. 4 embodiment an alignment indicator 40 is attached to a rear portion of the club head 12 such that it extends rearwardly along an axis 42 which lies transverse to the club face 44. This alignment indicator 40 is preferably comprised of a coil spring, but may also comprise a rigid bar or strip if desired. Preferably, the indicator 40 is removably attachable to the club head 12, for example by engaging it with a clip 41 disposed on the rear top center of the club head, and its purpose is to assist the golfer in aligning the club with the target line the golfer has established between the golf ball and the hole. In practice, then, the golfer determines the lie of the green, in known fashion, and the desired path of travel, for the ball to compensate for the lie and reach the hole. Once the desired path of travel has been determined, an initial target line (the initial direction the ball needs to travel in order to traverse the desired path of travel) is established. As the golfer lines up his shot, the alignment indicator provides him with a means for ensuring that his club head is properly aligned to initiate the ball along the target line, merely by ensuring that the alignment indicator and its extension axis 42 are coincident with the target line.

Preferably the alignment indicator 40 comprises a coil spring of suitable tension, because it can be manipulated, distorted, and abused, yet return to its original form and position. Thus, if a coil spring is used, it can be mounted permanently, and stand up to the inevitable abuse it will receive during the course of play and storage in the golf bag. In the preferred embodiment, a coil spring having an initial tension of 0.63 lb., with an OD of 3/16 in. and a length of 2½ inches is employed. On the other hand, if a rigid bar is used as the alignment indicator, it should be removed by the golfer between uses in order to preserve its integrity.

Another difference between the embodiments of FIGS. 3 and 4 is the use in the FIG. 4 embodiment of a spacer 45 to separate the club head from the hosel frame, which may in some circumstances have certain constructional advantages..

Referring again particularly to FIG. 2, which illustrates a first preferred embodiment of a club head 12, it will be noted that the club head includes a straight narrow ridge 46 extending along its length, preferably disposed even with the face 44 of the club head (FIG. 4) and across its top. This ridge or straight edge 46, which preferably extends along the full length of the club face 44, is provided for the purpose of helping the golfer square the club with the target line when setting up a putt. When used in conjunction with the alignment indicator 40, the target line is precisely determined, thereby refining and improving the accuracy of the resultant putt.

Still another unique feature of the inventive club head 12, as illustrated in FIG. 2, is the provision of slots 48 therein. The two-point mounting of the hosel frame 16 to the club head 12 permits the concentration of club head weight centrally between the two mounting points. By varying the number of slots and their depth, the weight of the club can be refined according to desired performance, and by locating the slots 48 in the upper half of the club head, the center of mass of the club head is lowered and concentrated nearer to the bottom. This lower center of mass permits better control of the club head and swing, and engages the golf ball more favorably at impact. A residual benefit of the inventive slotting technique, as well, is the enhanced appearance they lend to the club head.

Figure 5A:
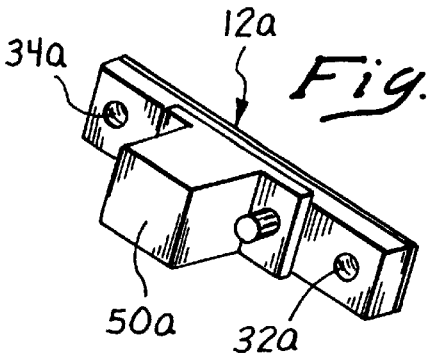
FIG. 5*a* is a perspective view similar to that of FIG. 2, illustrating a second modified embodiment of a golf putter head constructed in accordance with the principles of the present invention.
Figure 5B:
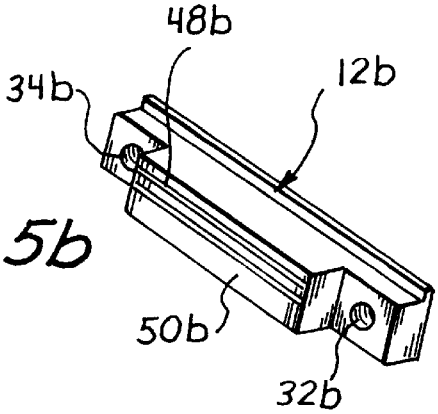
FIG. 5*b* is a perspective view similar to that of FIG. 2, illustrating a third modified embodiment of a golf putter head constructed in accordance with the principles of the present invention.
Figure 5C:
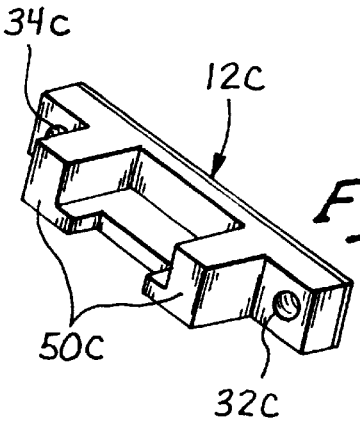
FIG. 5*c* is a perspective view similar to that of FIG. 2, illustrating a fourth modified embodiment of a golf putter head constructed in accordance with the principles of the present invention.
Figure 5D:
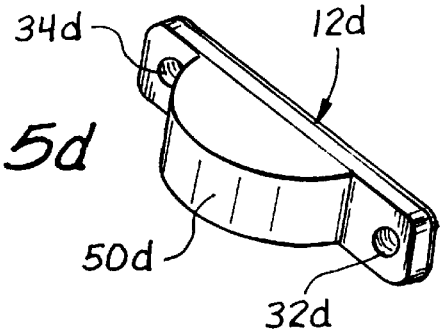
FIG. 5*d* is a perspective view similar to that of FIG. 2, illustrating a fifth modified embodiment of a golf putter head constructed in accordance with the principles of the present invention.

FIGS. 5*a,* 5*b,* 5*c,* and 5*d* each show a modified embodiment of the club head 12, designated as 12*a,* 12*b,* 12*c,* and 12*d,* respectively. Each of these modified embodiments may be used interchangeably with one another and with the preferred club head 12, depending upon the desired feel of the club. Each of the club heads 12, 12*a,* 12*b,* 12*c,* and 12*d* include a weighted portion 50, 50*a,* 50*b,* 50*c,* 50*d,* respectively, which distributes the weight of the club head in a particular way between the two mounting points 32, 34. Arranging the weight of the club head between the two hosel frame mounting points functions to focus the force of the momentum of the club head at the ball during the swing, so that the club is in better balance and control and has less tendency to wobble during the swing.

Figure 9:
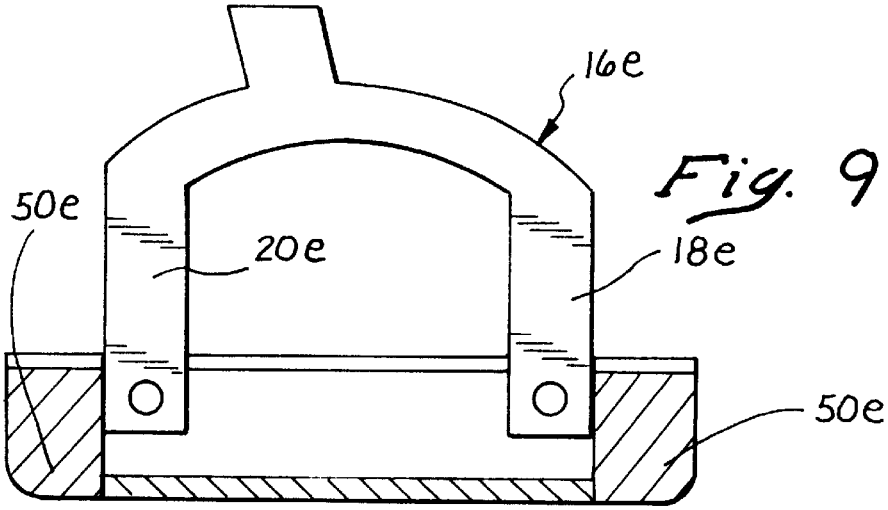
FIG. 9 is a cross-sectional view of another modified embodiment of a golf club head for a putter.

Other club heads may be used, as well, which divide and distribute the weight outside of the mounting zone between the club head and the hosel frame. With this arrangement, a stable swing with another desirable feel of the club is achieved. One such putter head 12*e* is illustrated in FIG. 9, comprising weighted portions 50*e,* neither of which is disposed between the two mounting points 32*e,* 34*e.*

Figure 6:
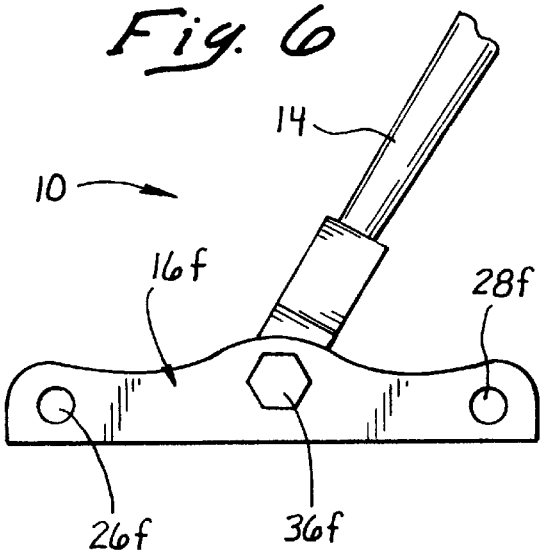
FIG. 6 is a front plan view similar to that of FIG. 1, illustrating a modified embodiment of a shaft and hosel frame for a golf club, constructed in accordance with the principles of the invention.

Referring now particularly to FIG. 6, a modified embodiment of the inventive golf putter 10*f* is illustrated, wherein all like elements to those illustrated in FIG. 1 are designated by the same reference numeral, followed by the letter f. In this embodiment, the hosel frame 16*f* comprises a solid piece construction rather than a two prong construction, so that the hosel frame 16*f* adjoins the rear surface of the club head along its entire length between the two mounting points 26*f* and 28*f.*

The common feature in each of the disclosed embodiments is the attachment of the hosel frame 16, 16*f* to the club head 12 (or its variants) at discrete mounting locations 32, 34 (or their variants). The length of club head 12 between the discrete mounting locations 32, 34 can be referred to as the attachment zone 51 (FIG. 2). It is within the scope of the invention that the attachment of the shaft to the club head could be by means of a continuous joint, by, for example, welding or casting, between the hosel frame 16*f* and the club head 12, such that the mounting locations 32, 34 of the club head do not receive mechanical fasteners, or comprise discrete attachment points, but rather merely define the opposing edges of the attachment zone 51.

Figure 7:
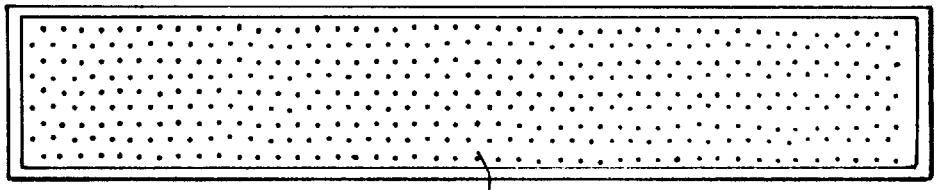
FIG. 7 is a front plan view of one embodiment of a club head for a putter constructed in accordance with the present invention.
Figure 8:
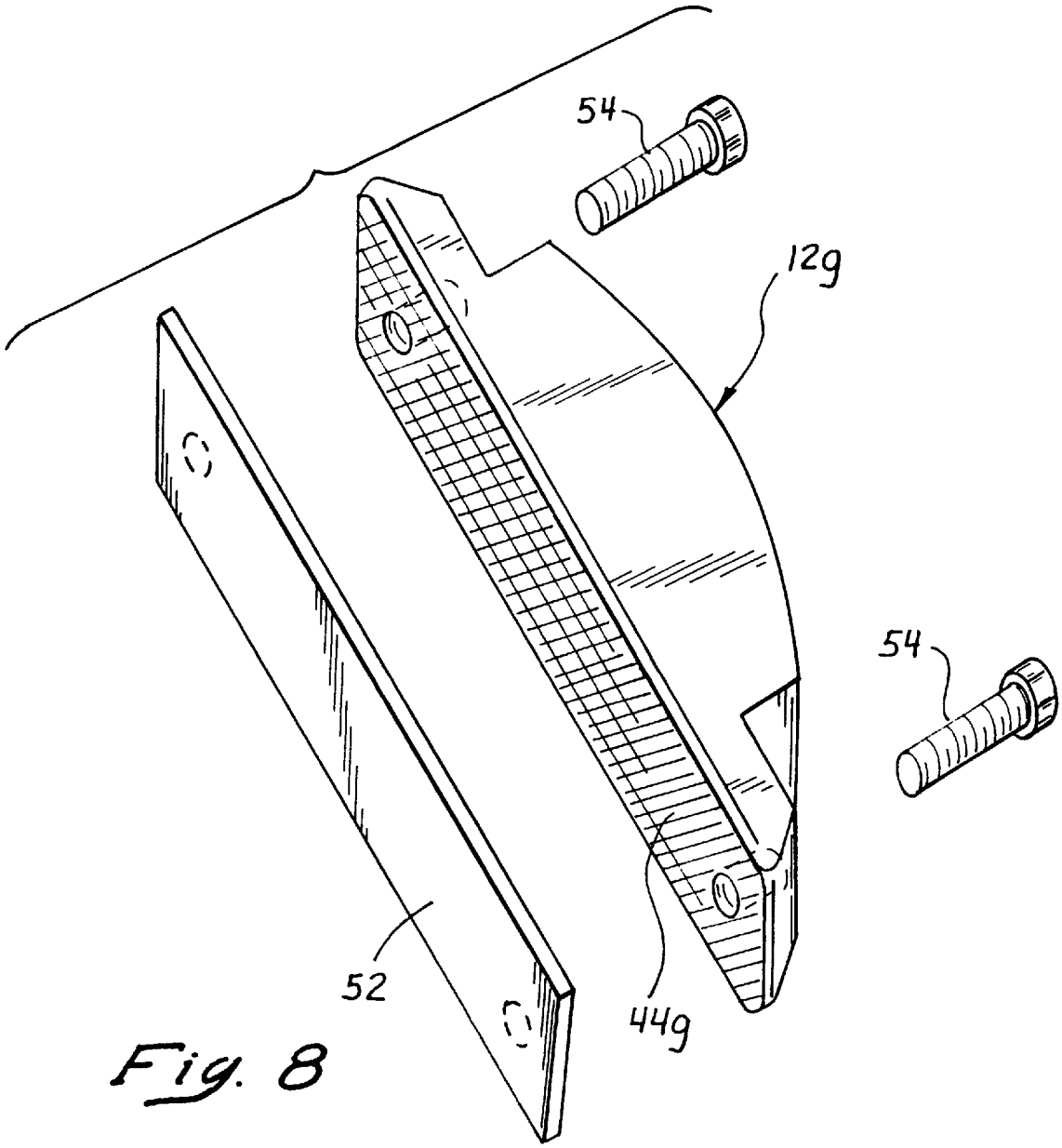
FIG. 8 is a perspective view of the club head illustrated in FIG. 7, showing the attachment thereto of a face plate constructed of a special material for desired soft feel and roll.

Referring now more particularly to FIGS. 7 and 8, a modified embodiment of a club head 12*g* constructed in accordance with the principles of the invention is shown. In this embodiment, the face 44*g* of the club head 12*g* is textured by a series of raised dots or cross-hatched grooves, creating peaks and valleys which are adapted to form a backing for a layer 52 of softening material which may be attached to the face 44*g* of the club by means of mechanical fasteners 54 or other equivalent means, such as adhesive, welding, or the like. Improving the softening effect improves the impact, the control of the ball, and the roll of the ball. The impact has a softer and more manageable feel.

As stated supra, it is within the scope of this invention to attach the shaft to the club head using one continuous joint, as long as that joint spans or extends along at least 30 percent, and preferably at least 50 percent of the entire length of the club head, so that an equivalent effect of the preferred two point mounting is achieved. If the two point mounting illustrated in the drawings is used, the spacing between the two mounting points (the attachment zone 51) should also equal at least 30 percent and preferably at least 50 percent of the length of the club head.

It should also be noted that, while the preferred embodiment of the invention is a golf putter, the principles of the invention apply to other types of golf clubs as well.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A golf club comprising:

a shaft;

a club head having a front face, a length along which said front face extends, and a rear portion, said front face being adapted to strike a golf ball and said rear portion having a mounting surface parallel to said front face and two discrete mounting locations disposed thereon;

a hosel frame disposed between said shaft and said club head, said hosel frame comprising two prongs, each of which have a lower portion which extends linearly in a direction parallel to said front face;

the lower portions of each of said prongs being attached to said club head rear portion at corresponding ones of said two mounting locations said club head comprising slots of a predetermined number and depth in an upper half thereof for the purpose of controlling weight and weight distribution.

2. The golf club recited in claim 1, said golf club comprising a putter.

3. The golf club recited in claim 1, wherein said club head further comprises a weighted portion disposed between said mounting locations, such that said mounting locations are disposed in notches displaced forwardly of said weighted portion.

4. The golf club recited in claim 1, and further comprising a layer of softening material disposed on the front face of said club head.

5. The golf club recited in claim 1, and further comprising spacers disposed between said prong lower portions and said corresponding mounting locations.

6. The golf club recited in claim 1, where said hosel frame is attached to said shaft with a mechanical fastener.

7. A golf club comprising:

a shaft;

a club head having a front face, a length along which said front face extends, and a rear portion, said front face being adapted to strike a golf ball;

a hosel frame disposed between said shaft and said club head for attachment of said shaft to said club head; and a spacer disposed between said hosel frame and said club head, to ensure that said hosel frame and said club head are spaced a predetermined distance apart when attached to one another.

8. The golf club recited in claim 7, wherein said hosel frame is attached to said club head with a mechanical fastener having a shaft, and the spacer comprises a cylindrical element disposed about said fastener shaft.

9. The golf club recited in claim 8, wherein said mechanical fastener comprises a bolt.

10. The golf club recited in claim 7, wherein said hosel frame comprises two prongs, each of which have a lower portion which extends linearly in a direction parallel to said front face;

the lower portions of each of said prongs being attached to said club head rear portion at corresponding ones of two mounting locations.

11. The golf club recited in claim 9, wherein said club head further comprises a weighted portion disposed between said mounting locations, such that said mounting locations are disposed in notches displaced forwardly of said weighted portion.

12. The golf club recited in claim 7, wherein said golf club comprises a putter.

13. The golf club as recited in claim 7, wherein the hosel frame is attached to the shaft with a mechanical fastener.

14. A golf club comprising:

a shaft;

a club head having a front face, a length along which said front face extends, and a rear portion, said front face being adapted to strike a golf ball, said rear portion having a mounting surface generally parallel to said front face and two discrete mounting locations disposed thereon;

the club head further comprising a weighted portion disposed between said mounting locations, such that said mounting locations are disposed in notches displaced forwardly of said weighted portion.

15. The golf club recited in claim 14, and further comprising a hosel frame disposed between said shaft and said club head, said hosel frame comprising two prongs, each of which have a lower portion which extends linearly in a direction parallel to said front face;

the lower portions of each of said prongs being attached to said club head rear portion at corresponding ones of said mounting locations.

16. The golf club recited in claim 15, and further comprising spacers disposed between said prong lower portions and said corresponding mounting locations.

17. The golf club recited in claim 14, wherein said golf club comprises a putter.

18. The golf club recited in claim 16, wherein said hosel frame is attached to said club head with a mechanical fastener having a shaft, and the spacer comprises a cylindrical element disposed about said fastener shaft.

* * * * *